US006883189B2

(12) United States Patent
Pierce

(10) Patent No.: US 6,883,189 B2
(45) Date of Patent: Apr. 26, 2005

(54) CONCEALED TOILET CLEANING SYSTEM

(76) Inventor: Kristi Pierce, 41197 -268th Ave., Vergas, MN (US) 56587

( * ) Notice: Subject to any disclaimer, the term of this patent is extended or adjusted under 35 U.S.C. 154(b) by 0 days.

(21) Appl. No.: 10/328,619

(22) Filed: Dec. 23, 2002

(65) Prior Publication Data

US 2004/0117900 A1 Jun. 24, 2004

(51) Int. Cl.[7] ..... A47K 17/00; E03D 1/00; E03D 9/00

(52) U.S. Cl. ..... 4/661; 4/255.11; 4/353

(58) Field of Search ..... 4/353, 363–365, 4/661, 255.11, 255.12, 255.05; 248/110–113, 302, 689, 690, 692; 211/65

(56) References Cited

U.S. PATENT DOCUMENTS

| | | | | | |
|---|---|---|---|---|---|
| 2,434,399 | A | | 1/1948 | Duckenfield | 4/68 |
| 2,495,498 | A | | 1/1950 | Allard | 4/97 |
| 2,701,702 | A | * | 2/1955 | Diederich | 248/302 |
| 2,787,432 | A | * | 4/1957 | Diederich | 248/110 |
| 3,172,415 | A | * | 3/1965 | Maushund | 134/93 |
| 4,918,769 | A | * | 4/1990 | Gandini | 4/661 |
| 5,114,006 | A | | 5/1992 | Wilk | 206/349 |
| 5,305,880 | A | | 4/1994 | Wilk | 206/349 |
| 5,335,374 | A | | 8/1994 | Wilk | 4/255 |
| 5,640,722 | A | | 6/1997 | Bui | 4/353 |
| 5,862,536 | A | | 1/1999 | Huang | 4/353 |
| 5,958,150 | A | | 9/1999 | Borger | 134/42 |
| 6,055,680 | A | * | 5/2000 | Tolbert | 4/255.11 |

* cited by examiner

*Primary Examiner*—Charles E. Phillips
(74) *Attorney, Agent, or Firm*—Fredrikson & Byron, PA

(57) ABSTRACT

The present invention relates to a system for concealing a cleaning device such as a toilet plunger within a toilet flush tank. A modified toilet plunger has been designed to include a hinge so that the plunger cup can pivot on the end of the plunger handle, thereby taking up less space. The folded toilet plunger is secured to the inside of the toilet flush tank by a holder, preferably on the toilet flush tank cover, so that the toilet plunger is readily accessible yet out of sight and will drain into the toilet flush tank after use.

4 Claims, 2 Drawing Sheets

CONCEALED TOILET CLEANING SYSTEM

FIELD OF THE INVENTION

The present invention relates to toilet cleaning devices which may be concealed within the flush tank of a toilet, and more particularly to a foldable toilet plunger device which may be concealed and attached to the interior surface of a toilet.

BACKGROUND OF THE INVENTION

Toilet plungers and other cleaning devices have long been used to unblock and clean toilet drains. It is preferable to store such devices out of sight, since they are generally unsightly and unsanitary, but such devices are often difficult to store because of the limited amount of space in most bathrooms. Furthermore, the means of storage should securely support the cleaning devices and allow for drainage, yet allow them to be readily available when needed to clean or remove blockages in the drains.

Earlier efforts have attempted to respond to the storage and convenience-of-use problems, providing toilet plunger covers and/or combination toilet plunger covers and toilet plungers. For example, in U.S. Pat. No. 5,114,006 to Wilk, and U.S. Pat. Nos. 5,335,374 and 5,305,880 to Wilk et al., the toilet plunger housing is part of the toilet plunger. The Wilk ('006) combination toilet plunger and housing device has a housing with a slotted base which rests directly on the floor, wherein the plunger cup rests upon the slots when the plunger is in storage, and the same slots are used for grasping of the housing when the plunger is extended for use. Other embodiments of Wilk ('006) disclose the plunger cup resting on a removable base plate when the plunger is in a storage position. The '374 and '880 patents further expand upon this basic concept.

More recently, in U.S. Pat. No. 5,958,150 by Borger et al. disclosed a separate storage device which can be opened and closed without being manipulated directly by the user. The storage device also serves to partially conceal the plunger when closed and allows the plunger to drain while sitting in the device. Both the Borger and Wilk devices are stand-alone assemblies for housing the plunger apart from the toilet.

U.S. Pat. No. 2,701,702 by Deiderich, on the other hand, provides an accessory for use within a toilet flush tank which supplies deodorant or disinfectant and may also support a toilet brush. The accessory is preferably a metal wire apparatus which is supported by the overflow pipe. Thus use of toilet plungers is not disclosed in the '702 patent.

Thus, while there has been substantial effort in the design of bathroom accessory storage devices for toilet plungers and other cleaning devices, the art has not adequately responded to date with the introduction of a means for storing a toilet plunger or other cleaning device which securely stores the toilet plunger or other cleaning device in a concealed fashion that allows for drainage and ready access, while not occupying additional scarce bathroom space or presenting an unattractive visage. The present invention substantially fulfills this need.

SUMMARY OF THE INVENTION

The concealed toilet cleaning system of the present invention provides a system for concealing and storing a toilet plunger within a toilet flush tank to allow for drainage and ready access to the plunger without occupying additional space within the bathroom or risking unsanitary and unsightly exposure to the toilet plunger when the toilet plunger is not in use. Furthermore, the present invention provides a toilet plunger device which can be more readily stored within a toilet flush tank. Additionally, the cleaning system of the present invention provides a method of storing and using a concealed toilet plunger or toilet brush.

Generally a holder is attached to the interior of the toilet flush tank in order to secure the toilet plunger out of sight within the toilet flush tank. The holder retains the plunger or other cleaning device securely so that it does not detach and drop into the toilet flush tank. Preferably, this holder is secured to the cover of the flush tank. Furthermore, in one embodiment, the toilet plunger is fashioned to include a pivot point behind the plunger cup to allow the toilet plunger to be folded so that it is more planar and can be more readily stored close to the surface of the interior of the toilet flush tank. The holder within the toilet flush tank can also be used to secure and conceal other toilet cleaning devices (ex. a toilet brush).

The present invention allows the toilet plunger to be concealed within the flush tank of a typical household toilet, thus allowing any household toilet to be readily converted into a storage device. Through use of a folding toilet plunger, the plunger can be much more readily stored within the toilet flush tank since it less bulky when folded. In particular, when folded it is much more planar and therefore adapted to be closely positioned to the toilet flush tank cover. In addition to preventing unsightly exposure to the toilet plunger, storage within the toilet flush tank is also more sanitary as it prevents contamination of the bathroom by waste material which may accumulate on the plunger cup. Storage within the toilet flush tank also facilitates the drying of the toilet plunger by allowing residual moisture to drain into the lower portion of the toilet flush tank.

Those skilled in the art will appreciate that the conception upon which this disclosure is based may readily be utilized as a basis for the design of other structures and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The above and other objects and aspects of the invention will be apparent from the description of embodiments illustrated by the following accompanying drawings.

DETAILED DESCRIPTION OF THE PREFERRED EMBODIMENTS

The present invention relates to a concealed toilet cleaning system. Generally, the cleaning system of the present invention includes a toilet cleaning device and a holder 16 for releasably securing the toilet cleaning device to an interior surface of a toilet flush tank 12. The toilet cleaning device of the present invention normally comprises a handle 24 and a cleaning attachment, such as a plunger cup 26 or a toilet brush (not shown).

Figure 1:
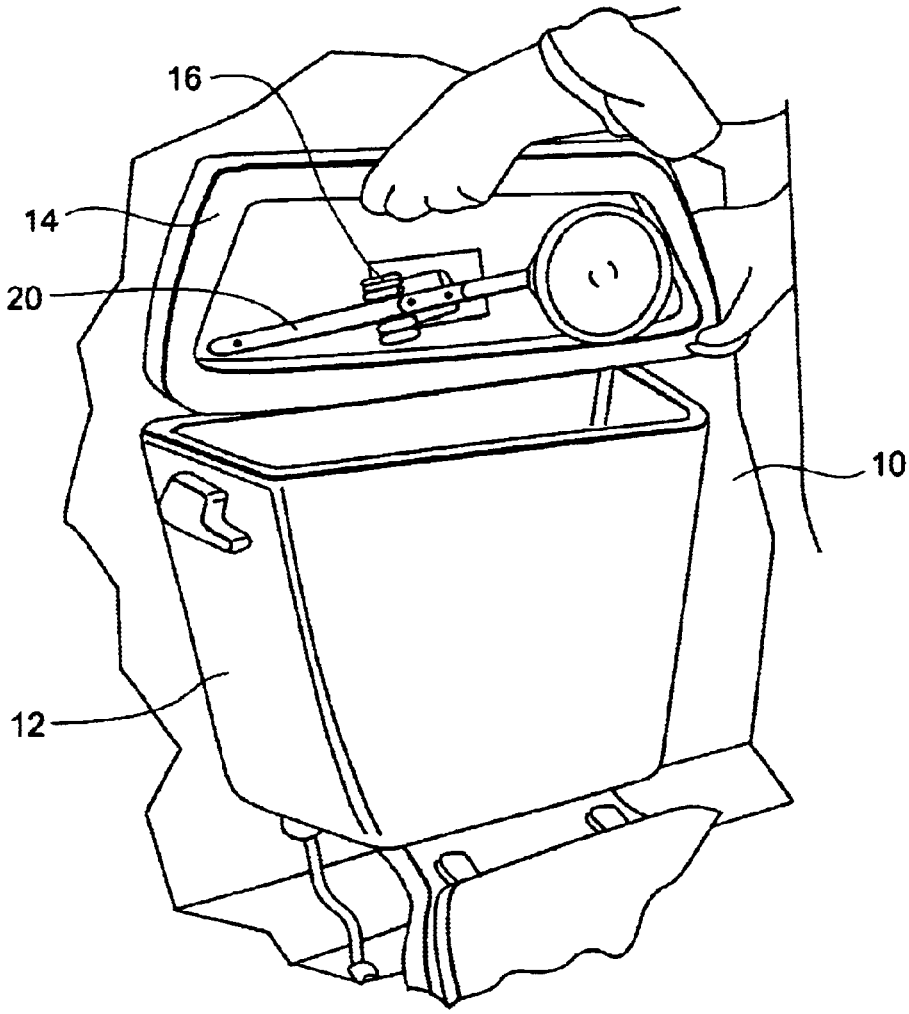
FIG. 1 is a perspective view of a toilet flush tank where the cover has been lifted to reveal an attached toilet plunger.

A concealable toilet plunger storage system in accordance with an embodiment of the present invention will now be described with reference to FIGS. 1 and 2. Referring to FIG. 1, a conventional toilet 10 is shown, focusing on the upper toilet flush tank 12. Both components are typically made of porcelain, though many other materials with similar properties can be used. The toilet flush tank contains the water reservoir and apparatus necessary to operate the toilet. Toilet flush tanks are typically provided with a toilet flush tank cover 14 which enables easy access to the toilet flush tank for maintenance or other purposes.

An embodiment of the toilet plunger 20 of the present invention is shown in FIG. 1 secured to the bottom surface of the toilet flush tank cover 14. While it is preferable to secure the toilet plunger to this surface, as this surface provides the most ready access, the use of other surfaces within the toilet flush tank for mounting the toilet plunger 20 are also envisioned, as other surfaces will allow the toilet plunger 20 to be securely stored in an inconspicuous location while allowing drainage and satisfying various other criteria. The typical toilet flush tank 12 contains a flush mechanism and a float device (not shown), which present potential obstacles to the toilet plunger 20. Thus, it is most preferable to position the toilet plunger 20 so that the plunger cup 26 is positioned over the float device, as there is typically more space available here than over the flush mechanism. Toilets that have anti-siphon ballcock devices rather than a float device will generally have a greater amount of space. When less room is available for the toilet plunger 20, a light-duty 4" plunger cup size can be used. As will be described below, the plunger is preferably capable of folding in order to take up less space within the toilet flush tank.

A holder 16 is used to secure the toilet plunger 20 to whatever portion of the toilet flush tank 12 surface is chosen. A wide variety of devices can serve as the holder 16; all that is necessary is to be able to attach the holder to the surface of the toilet and then use it to releasably grip the toilet plunger so that it can be positioned within the flush tank but withdrawn for use. The holder may be secured to the surface of the toilet flush tank 12 or the toilet flush tank cover 14 using a variety of adhesives, or other attachment means such as clamps, bolts, or screws Alternately, the holder 16 may be integrated into the surface of the flush tank 12 or flush tank cover 14 at the time of manufacture. In one embodiment, a Velcro® fastener with an adhesive backing may be used, as this allows the holder to be repositioned as needed. Preferably, the holder grips the handle of the plunger using friction and tension. There are a variety of hardware clips, such as roller jaw clips, that can be used to hold the toilet plunger 20. A preferred holder 16 is a broom clip composed of a semi-rigid plastic or metal.

Figure 2:
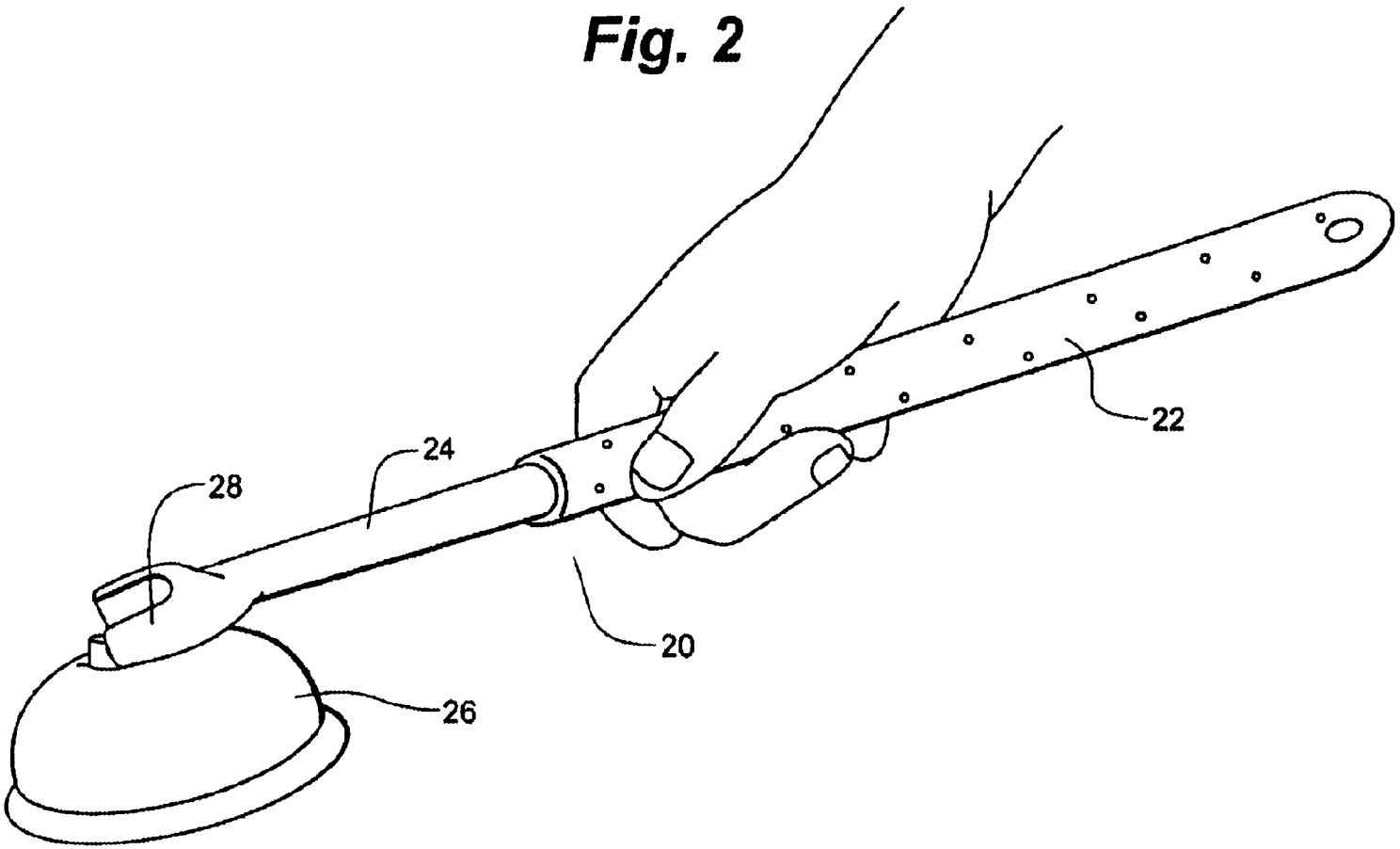
FIG. 2 is a perspective view of a toilet plunger with an elongated handle and pivoting plunger cup.

Referring to FIG. 2, the toilet plunger 20 can be of a conventional type and is comprised of an elastomeric or resilient plunger cup 26 and an elongated handle 24 having one end attached to or inserted into cup 26. As previously suggested, the cup 26 is made of an elastomeric or resilient material. Suitable cup materials include, but are not limited to, rubber, neoprene or any elastic polymer. A conventional plunger typically has a 6" plunger cup and 20" handle. However, any size cup or handle that can fit within the toilet tank can be utilized in the present invention. The handle 24 is preferably an elongated cylinder or rod, but many other shapes that transmit force and distance the user from the working cup 26 (i.e., function as a handle) can be used. The handle is preferably composed of a rigid material such as acrylic plastic which resists damage from moisture within the flush tank. Other suitable handle materials are metal, fiberglass, or water-resistant wood. Preferably, the handle 24 attaches to the cup 26 by means of a hinge 28 which allows the cup 26 to pivot so that the plane defined by cup 26 is parallel rather than perpendicular to the line formed by the handle 24. In an alternate embodiment, the hinge 28 may include a locking mechanism to prevent the cup 26 from wobbling while being used. Once folded, the toilet plunger 20 will take up much less space within the toilet flush tank 12. It is also preferable to sheath the cylindrical handle 24 in a elastomeric or rubber-like grip material 22 which makes it easier to securely hold the toilet plunger. In another embodiment, the handle of the toilet plunger 20 is designed so that it can be collapsed to reduce its length. For example, the plunger handle 24 could be made of several overlapping cylinders capable of telescoping into the outer cylinder for storage within the flush tank 12.

To use the toilet plunger 20, the toilet flush tank cover 14 is first lifted to reveal the toilet plunger 20. The plunger 20 is then removed from its holder 16, unfolded, and used to unblock the toilet. After use, the toilet plunger 20 is refolded and secured back to the holder 16 and the toilet flush tank cover 14 is replaced on the toilet flush tank 12. A label, preferably one with a logo and made up of transparent plastic, can be used to designate the toilet as one with a concealed plunger, in order to alert a potential user to the plunger's presence.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A toilet cleaning system comprising:

a toilet plunger and a holder for releasably attaching the toilet plunger to the interior of a toilet flush tank, the toilet plunger comprises a handle including a hinge to allow the toilet plunger to be folded and a plunger cup, and the holder comprises a resilient material that exerts tensive force against an inserted toilet cleaning device, thereby retaining the toilet plunger in place.

2. The apparatus of claim 1 wherein the holder is a broom clip.

3. A method of storing and using a concealed toilet plunger comprising the steps of:

a) removing a toilet flush tank cover from a toilet flush tank, b) removing a toilet plunger from a holder that exerts tensive force against an inserted toilet plunger on the toilet flush tank cover, c) utilizing the toilet plunger within the toilet d) replacing the toilet plunger in the holder on the toilet flush tank cover, and e) replacing the toilet flush tank cover upon the toilet flush tank;

wherein the toilet plunger is concealed from view underneath the toilet flush tank cover prior to removal of the toilet flush tank cover from the toilet flush tank.

4. The method of claim 3 including the further steps of unfolding the toilet plunger after removing the toilet plunger from a holder so that the toilet plunger cup is perpendicular relative to the toilet plunger handle, and refolding the toilet plunger after utilizing the toilet plunger within the toilet so that the toilet plunger cup is parallel relative to the toilet plunger handle.

* * * * *